US010629997B2

(12) United States Patent
Doudou et al.

(10) Patent No.: US 10,629,997 B2
(45) Date of Patent: Apr. 21, 2020

(54) RADIATING INTEGRATED ANTENNA UNIT AND MULTI-ARRAY ANTENNA OF SAME

(71) Applicant: Tongyu Communication Inc., Zhongshan, Guangdong (CN)

(72) Inventors: Samb Doudou, Zhongshan (CN); ZhongLin Wu, Zhongshan (CN); Mulin Liu, Zhongshan (CN); Isola Ari, Zhongshan (CN)

(73) Assignee: TONGYU COMMUNICATION INC., Zhongdang (CN)

( * ) Notice: Subject to any disclaimer, the term of this patent is extended or adjusted under 35 U.S.C. 154(b) by 0 days.

(21) Appl. No.: 16/072,398

(22) PCT Filed: Dec. 27, 2016

(86) PCT No.: PCT/CN2016/112469
§ 371 (c)(1),
(2) Date: Jul. 24, 2018

(87) PCT Pub. No.: WO2018/119702
PCT Pub. Date: Jul. 5, 2018

(65) Prior Publication Data

US 2019/0081407 A1 Mar. 14, 2019

(51) Int. Cl.
*H01Q 21/00* (2006.01)
*H01Q 15/22* (2006.01)
(Continued)

(52) U.S. Cl.
CPC ..... *H01Q 15/22* (2013.01); *H01Q 1/246* (2013.01); *H01Q 15/14* (2013.01);
(Continued)

(58) Field of Classification Search
None
See application file for complete search history.

(56) References Cited

U.S. PATENT DOCUMENTS 6,483,474 B1 11/2002 Desargant et al.
2014/0035792 A1* 2/2014 Schadler ..... H01Q 21/26 343/798

(Continued)

FOREIGN PATENT DOCUMENTS

CN 101018370 A 8/2007
CN 102299398 A 12/2011
EP 0 973 231 A2 1/2000

OTHER PUBLICATIONS

Sep. 27, 2017 International Search Report issued in International Patent Application No. PCT/CN2016/112469.

(Continued)

*Primary Examiner* — Trinh V Dinh
(74) *Attorney, Agent, or Firm* — Oliff PLC

(57) ABSTRACT

An integrated antenna unit where two dual-polarized radiating elements are connected on a PCB serving reflecting board as well as a filter lid of two-band pass filters. Each of two band-pass filter is connected directly to a two-way power splitter serving connection of same polarization from the two radiating elements. Two walls running parallel are extending at the band-pass filter edges to support the cavity of the filters and at same time serving as reflecting walls enabling to control the 3 dB azimuth beam generated by the radiating elements. Next, a multi-array antenna by collocating multiple arrays of the integrated antenna units.

15 Claims, 5 Drawing Sheets

(51) Int. Cl.

| | |
|---|---|
| ***H01Q 1/24*** | (2006.01) |
| ***H01Q 21/26*** | (2006.01) |
| ***H01Q 15/14*** | (2006.01) |
| ***H01Q 21/06*** | (2006.01) |

(52) U.S. Cl.
CPC ..... *H01Q 21/0062* (2013.01); *H01Q 21/0075* (2013.01); *H01Q 21/062* (2013.01); *H01Q 21/26* (2013.01)

(56) References Cited

U.S. PATENT DOCUMENTS

| | | | | |
|---|---|---|---|---|
| 2014/0118206 | A1 | 5/2014 | Hendry et al. | |
| 2016/0329641 | A1* | 11/2016 | Lee | H01Q 15/14 |
| 2018/0351246 | A1* | 12/2018 | Yu | H01Q 5/328 |

OTHER PUBLICATIONS

Sep. 27, 2017 Written Opinion of the International Searching Authority issued in International Patent Application No. PCT/CN2016/112469.

* cited by examiner

RADIATING INTEGRATED ANTENNA UNIT AND MULTI-ARRAY ANTENNA OF SAME

TECHNICAL FIELD

The present invention relates to wireless communication, and especially to a radiating integrated antenna unit and a multi-array antenna of the same.

BACKGROUND ART

Regular antenna systems are challenged by:

High-rise building coverage: Limited directive antennas (in azimuth/elevation plan) resulting on limitation in terms of high order sectorization.

Capacity lift at Macro Site and Uplink Coverage& Capacity Limited: for a given allocated time-frequency, there is still a challenge during multiplexing of different users due to small number of available antennas being able to direct azimuth narrow beam at desired direction while nulling interferers of intra- and inter-cell efficiently. Besides, business expansion along with difficulty in acquiring new site where UL: DL is 1:3.

High In-Building Capacity growth: even in claimed SU-MIMO, resources are not exploited fully due to limited size of user devices. Besides, higher cost for in-building system, with poor WLAN performance.

Massive MIMO antennas have been recently investigated to tackle the above challenges and being Key technology driving 4.5G and beyond. Spectrum efficiency is increased by smart collocated or conformal antenna arrays along with vertical beam adjustment. In one word, 3D MIMO with standards is being promoted with effort, prototype along with network deployment pilot. In the Long-term, beam forming in higher frequency and hardware progress will be considered.

In traditional Massive MIMO antennas, a cavity backed filter is generally used at the back of the antenna with number of outputs same as the number of antenna ports. And the inputs of the filter are connected to a number of Transmitting/Receiving circuits (from RRU). Besides costly development and implementation resources, drawbacks such as weight, size and integration flexibility issues as different hardware have to be designed separately prior to integrating.

Technical Problem

An object of the present invention is to provide a radiating integrated antenna unit, which has radiation at low frequency (cutting-off higher frequency) and improved inter-port isolation.

Another object of the present invention is to provide a multi-array antenna, of which no low-pass filtering is needed at the band-pass filter, thus improving the complexity of traditional band-pass design with cost effective.

Solution to Problem

Technical Solution

To achieve the main object, a radiating integrated antenna unit provided in accordance with embodiments of the present invention, comprises: two radiating elements; and an integrated filtering device for supporting the two radiating elements thereon. Each integrated filtering device comprises two band-pass filters and a PCB serving as a filter lid of both the band-pass filters and covered on top ends of the filters. The two radiating elements extend upwards from a top surface of the PCB.

Further, two two-way splitting networks are disposed on the top surface of the PCB. Each radiating element has a radiating surface and baluns under the radiating surface. Each band-pass filter has one input and one output. Each output of the band-pass filter is connected to an input of the two-way splitting network accordingly.

Each radiating element is dual-polarization with one monopole for each polarization. Each monopole comprises two radiating arms and one balun. The dual polarization has two baluns crossed to each other and four arms configured as a radiating plate with the radiating surface thereon. The same polarization of the two radiating elements is connected via one of the two two-way splitting networks.

Each balun comprises a substrate, a primary feed line printed at one face of the substrate, and a secondary feed line printed on the other face of substrate. The primary feed line serves as a feeding and carrying point where a signal can be inputted. The secondary feed line serves as a grounding support of the primary feed line. Two outputs of the two-way splitting network are respectively connected the primary feed lines of the two radiating elements with the same polarization.

A primary slot forms within the primary feed line; a secondary slot adjacent to the primary slot forms within the primary feed line; a combination of both primary and secondary slots has a low frequency cut-off.

The primary feed line extends from a bottom end to a top of the balun to connect to the radiating plate; the primary slot and/or the secondary slot is shaped as a square, a rectangle, or a circle. The secondary slot is located above the primary slot.

At least one tertiary slot is etched along the secondary feed line serving as resonance characteristic improvements as well as isolation between the two polarizations.

There are two tertiary slots are etched side by side along the secondary feed line.

The PCB is used as a reflecting board of two radiating elements whereby no additional reflector is needed, whereby reducing weight and enable cost saving of the integrated antenna unit.

Two reflecting walls running parallel are extending at edges of the two band-pass filters to support a cavity of the filters; and serve as pattern beam width control.

The two reflecting walls control a 3 dB azimuth beam generated by the radiating elements.

The PCB as the filter lid has a shape well matched with and covered top end surfaces of the two band-pass filters; and the PCB is fixed to the top ends of the two band-pass filters.

Each band-pass filter comprises a filter housing, the output of the band-pass filter is set on a top end surface of the filter housing, the input end of the band-pass filter is set at a bottom end surface of the filter housing; and the two inputs of the two band-pass filters are connected to a set of Transmitter/Receiver units.

To archive the other object of the present invention, a multi-array antenna in accordance with the embodiments, comprises multi-array of integrated antenna units. The multi-array antenna comprises multi-array of radiating elements and multiple band-pass filters integrated with multiple PCBs of the integrated antenna units; each PCB is used as a filter lid to cover on top ends of two combined band-pass filters in the same integrated antenna unit, and is also used as a reflector of two radiating elements of dual-polarization.

A multi-array antenna is proposed by a plurality of integrated antenna units where the inputs of the band-pass filters can be connected to a radio unit; so that multi-array active antennas can be obtained.

Advantageous Effects of Invention

Advantageous Effects

The integrated antenna unit in accordance with the embodiments of the present invention comprises two dual-polarized radiating elements connected on a PCB serving a reflecting board as well as a lid of two-band pass filters, each of two band-pass filter is directly connected to a two-way power splitter serving connection of same polarization from the two radiating elements. Thus the integrated antenna unit and the multi-array antenna have such advantages that:

1) having radiation at low frequency (cutting-off higher frequency) and improved inter-port isolation;

2) no low-pass filtering being needed at the band-pass filter; and 3) improving the complexity of traditional band-pass design with cost effective.

Furthermore, two walls running parallel are extending at band-pass filter edges to support a cavity of the filters and at same time serving as reflecting walls enabling to control the 3 dB azimuth beam generated by the radiating elements.

BRIEF DESCRIPTION OF DRAWINGS

Description of Drawings

Figure 1:
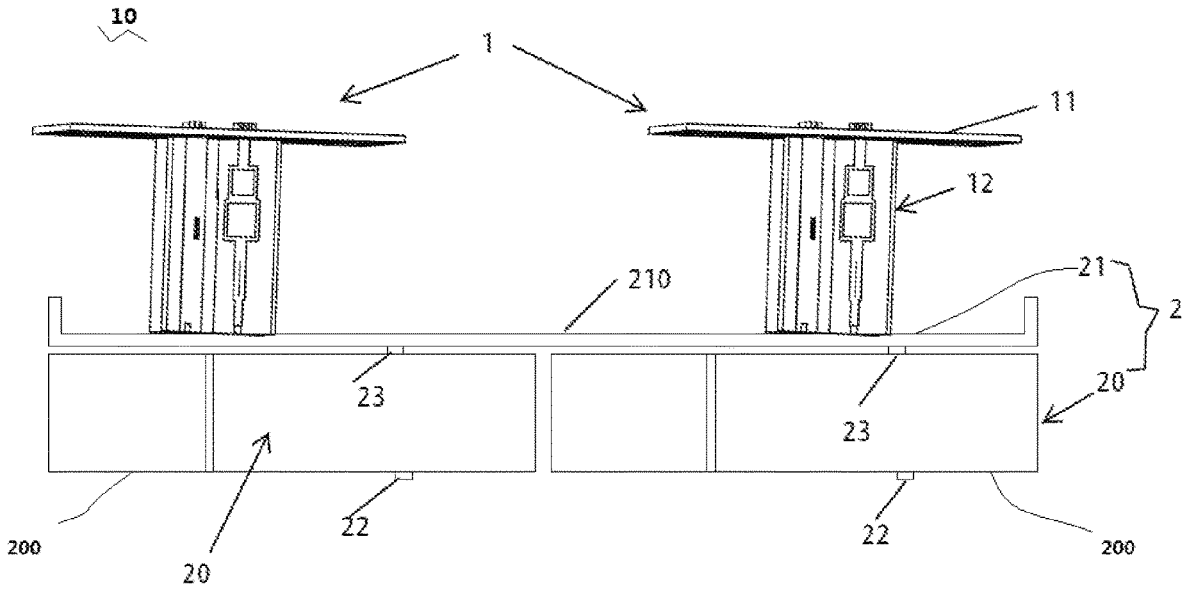
Figure 2:
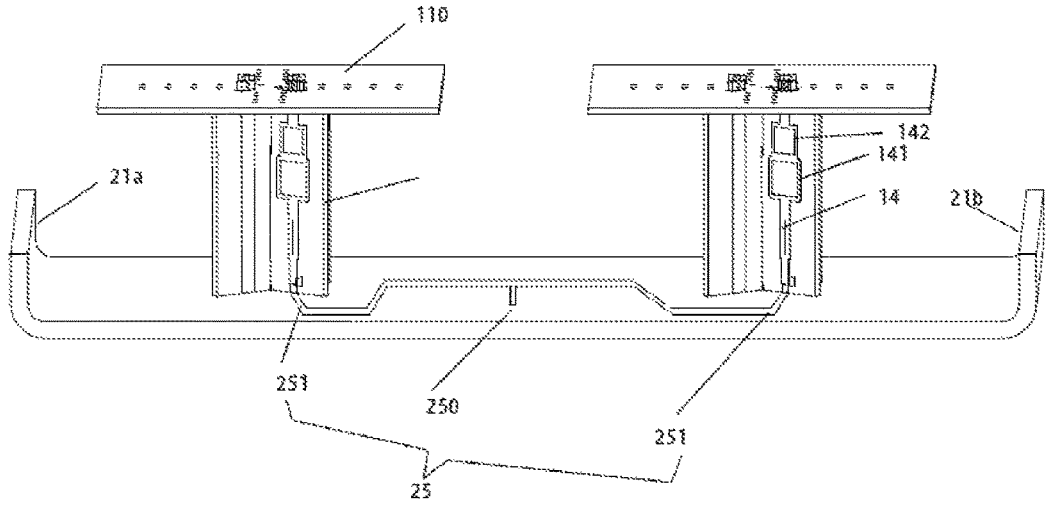
Figure 3:
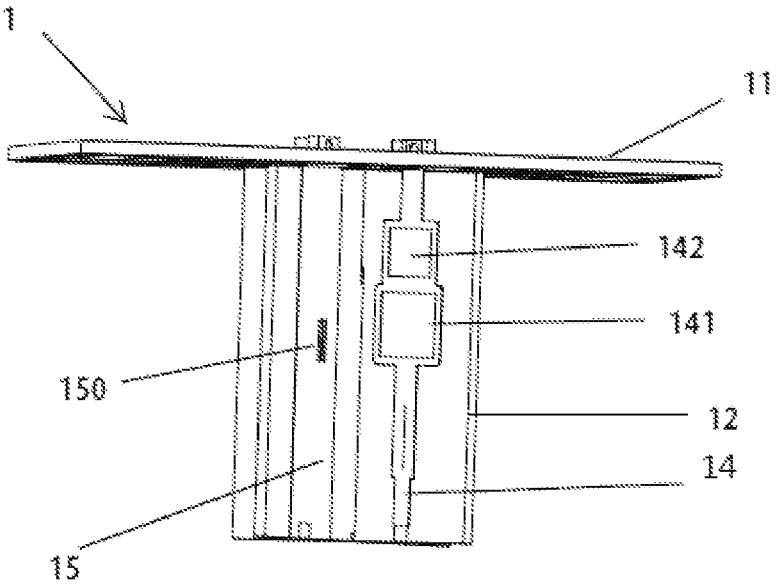
Figure 4:
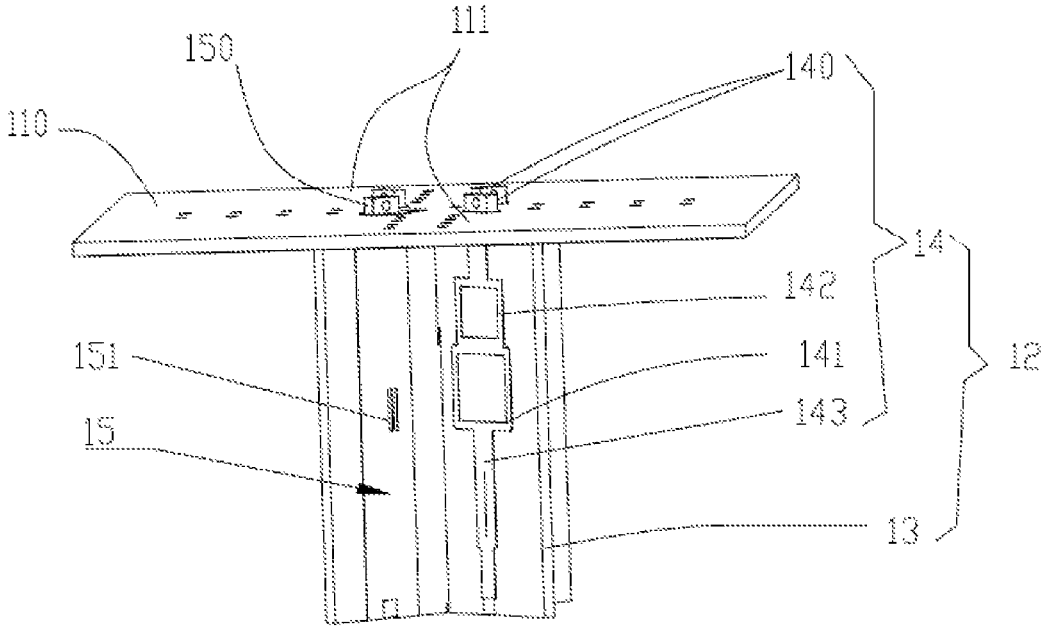
Figure 5:
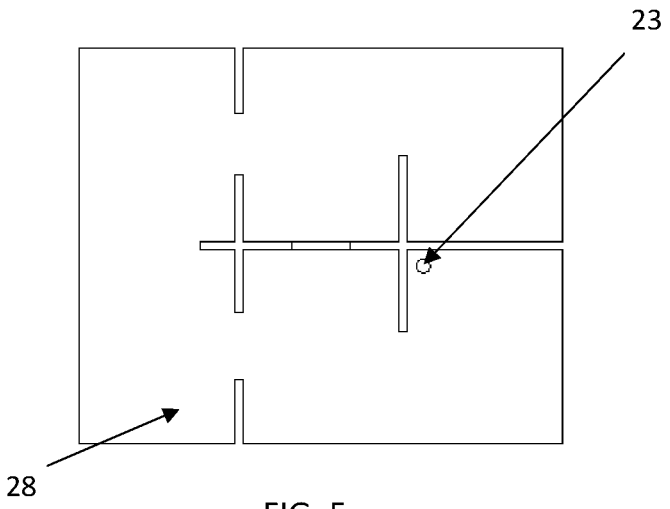
Figure 6:
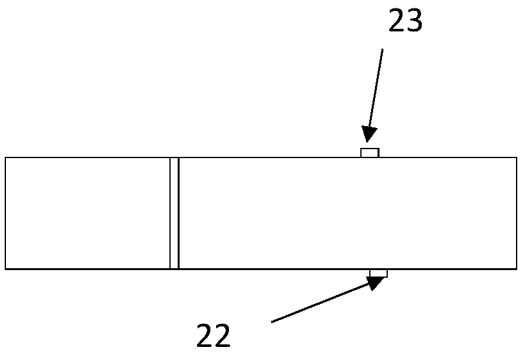
Figure 7:
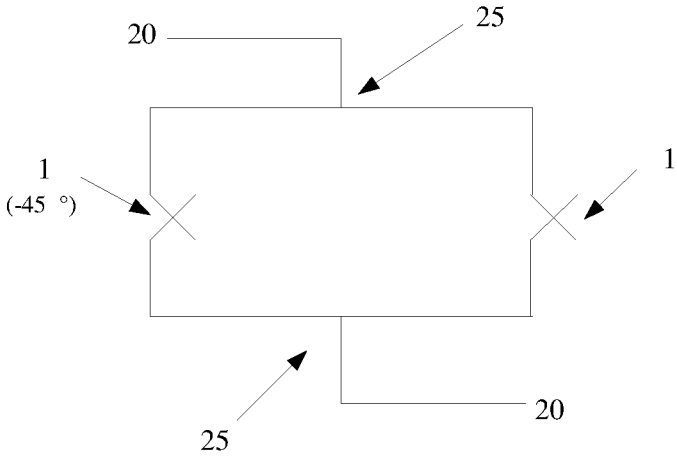
Figure 8:
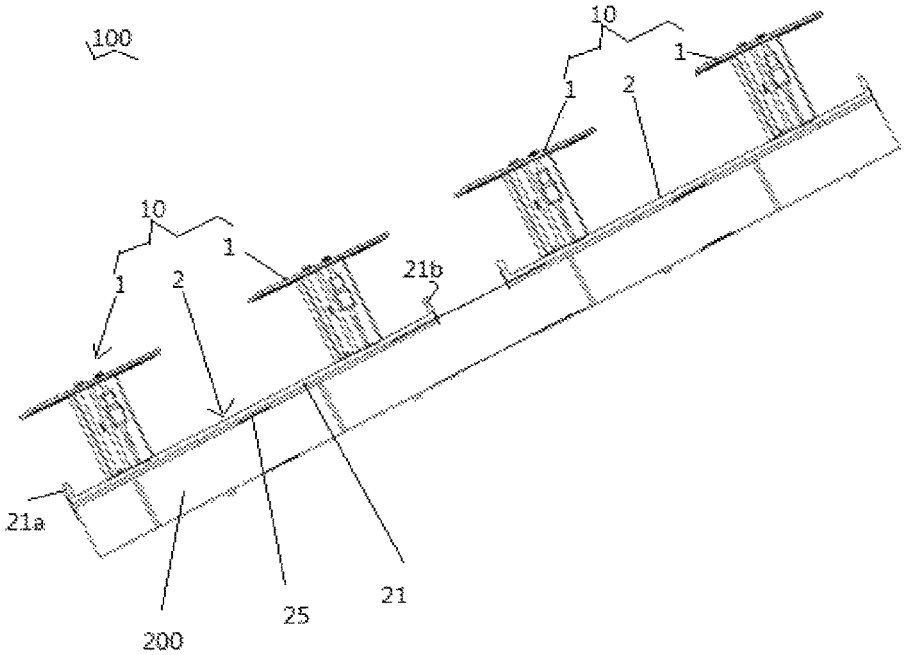
Figure 9:
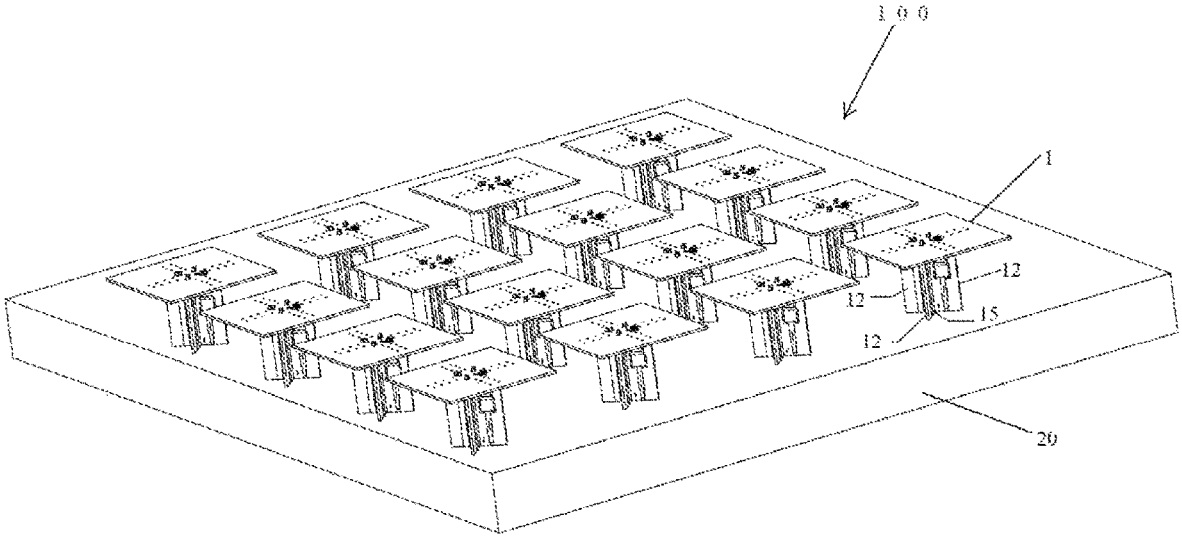
Figure 10:
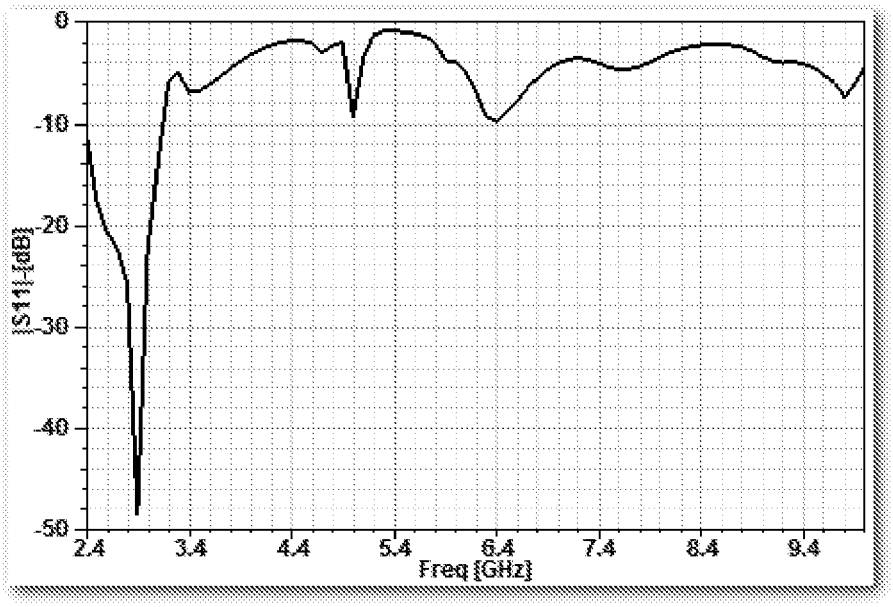
Figure 11:
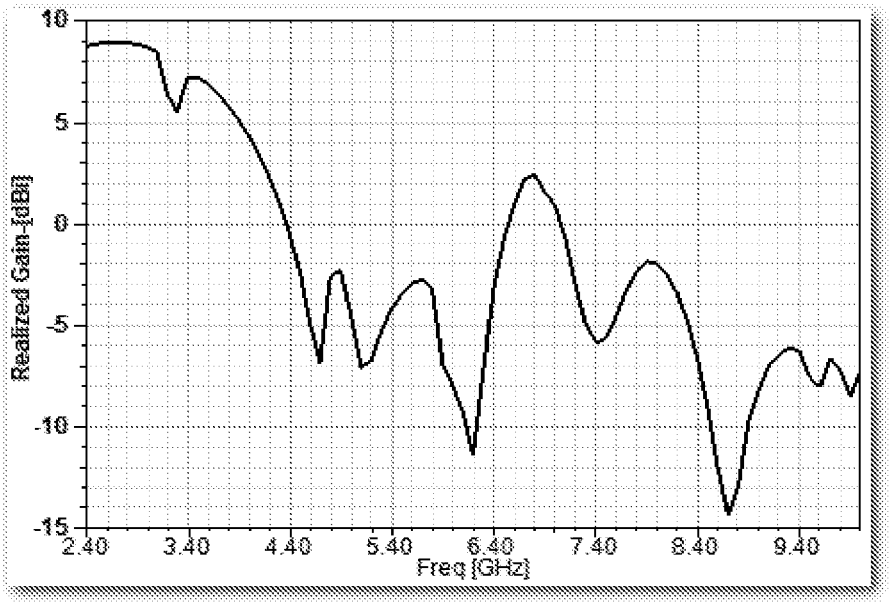

FIG. 1 is a plan view of a radiating integrated antenna unit in accordance with an embodiment of the present invention;

FIG. 2 is a perspective view of an upper part of the integrated antenna unit in FIG. 1;

FIG. 3 is a perspective view of a radiating element in accordance with the embodiment of the present invention;

FIG. 4 is another perspective view of the radiating element in accordance with the embodiment of the present invention;

FIG. 5 is a top view of a band-pass filter in accordance with the embodiment of the present invention;

FIG. 6 is a side view of the band-pass filter in accordance with the embodiment of the present invention;

FIG. 7 is a diagram of an electric circuit of the radiating integrated antenna unit;

FIG. 8 is a side view of a multi-array antenna in accordance with the embodiment of the present invention;

FIG. 9 is a perspective view of the multi-array antenna in accordance with the embodiment of the present invention;

FIG. 10 is a diagram of Return Loss of the radiating element with an integrated filtering; and FIG. 11 is a diagram of Realized Gain of the radiating element with the integrated filtering.

BEST MODE FOR CARRYING OUT THE INVENTION

Best Mode

The physical embodiments adopted in the present invention will be presented by the following depicted embodiments and accompanying drawings for further explanations.

Referring to FIGS. 1-6, a radiating integrated antenna unit 10 comprises two radiating elements 1, and two band-pass filters 20 and a PCB 21 integrated together to form an integrated filtering device 2 supported under both radiating elements 1. The integrated filtering device 2 is constructed by two band-pass filters 20 and the PCB 21 of the integrated antenna unit 10. The PCB 21 serving as the filter lip is covered on both top ends of the two band-pass filters 20 and forms a reflector of both the radiating elements 1, thus a top surface 210 of the PCB 21 accordingly is a reflecting surface for both the radiating elements 1. Both the radiating elements 1 extend upwards from the top surface 210 of the PCB 21.

Accordingly, the PCB, the filter lid and the reflector may use the same reference number 21 in the embodiments of the present invention.

Each band-pass filter 20 comprises a filter housing 200. The two band-pass filters 20 may have both filter housings 200 thereof combined to form a whole housing, and the whole housing may be configured as a shape of a column, such as a rectangular column. The PCB 21 is well covered on a top end of the whole housing.

Each band-pass filter 20 has the filter housing 200 made of metal and in a square shape as an exemplary embodiment. Each band-pass filter 20 comprises a top plate 28 (as shown in FIG. 5) at its top end, an output 23 of the band-pass filter 20 is set at the top plate 28, and an input 22 is set at a bottom plate (not labeled) of the filter housing 200 of the band-pass filter 20. The whole housing constructed by two band-pass filters 20 has two outputs 23 at its top end plate and two inputs 22 at its bottom end plate accordingly.

The PCB/filter lid 21 (as shown in FIGS. 1-2) has a shape matched with the two aligned top plates 28 of the two combined band-pass filters 20 in the radiating integrated antenna unit 10, and accordingly has a rectangular shape as an exemplary embodiment. The PCB/filter lid 21 covers on the rectangular-cylinder of the whole housing of both combined band-pass filters 20.

Two reflecting walls 21*a* and 21*b* (as shown in FIG. 2) running parallel are extending at edges of the combined two band-pass filters 20 to support a cavity of the filters 20 and at the same time serving as reflecting walls enabling to control the 3 dB azimuth beam generated by the radiating elements 1. Particularly, the two parallel reflecting walls 21*a* and 21*b* extend from both opposite edges of the PCB/lid cover 21, and serve as pattern beam width control on their heights.

The PCB 21 is soldered to the top plates 28 of both the filters 20 so as to cover on the top ends of both the filters 20. It is understood that a fixation means such as clamps, insertion means, threads or the like can be used to fix the filters 20 with the PCB 21 together.

In this embodiment, the filter lid 21 of the two resonators band-pass filters 20 is used as the PCB of the antenna unit 10 as well as a reflecting board of two radiating elements 1. So that no additional reflector is needed, thus reducing weight and enable cost saving.

In one embodiment, together referring to FIG. 7, each radiating element 1 features dual polarization, and comprises a radiating plate 11 and baluns 12 (as shown in FIGS. 3-4) vertically supported under the radiating plate 11. Each polarization has two arms 111 and one balun 12, thus each radiating element 1 has four arms 111 and two baluns 12 in accordance with this embodiment. Four arms 111 forms the radiating plate 11 with a top radiating surface 110 exposed in environment, and has a square shape as an exemplary embodiment. Both baluns 12 are crossed each other, vertically support the radiating plate 11 on top ends of both baluns 12, and vertically extend upwards from the top surface 210 of the PCB 21. In this embodiment, the two radiating elements 1 form ±45° polarization.

Each balun 12 comprises a substrate 13, a primary feed line 14 printed at one face of the substrate 13; and a secondary feed line 15 printed on the other face of the substrate 13, thereby the balun 12 forms a three-layer structure via the substrate 13 with the primary feed line 14 and the secondary feed line 15 respectively on its opposite faces. The primary feed line 14 serving as feeding and carrying point where a signal can be inputted from a given source. The secondary feed line 15 serving as grounding support of the primary feed line 14. A top end 140 of the primary feed line 14 extends through the radiating plate 11 to the top radiating surface 110 and is electrically connected with the corresponding radiating arm 111; and also a top end 150 of the secondary feed line 15 extends through the radiating plate 11 to the top radiating surface 110 and is electrically connected with the corresponding radiating arm 111.

A primary slot 141 is located within the primary feed line 14. A secondary slot 142 is adjacent to the primary slot 141 where a combination of both slots well enables to have a low frequency cut-off. In other words, the combination enables to eliminate the higher frequencies; so that the radiating elements 1 will operate at a lower frequency. The slots 141, 142 can be configured as a shape of square, rectangle, circle, or others, which is capable of a low frequency cut-off so as to eliminate the higher frequencies. In this exemplary embodiment, the slots 141, 142 are square, and the primary slot 141 has a bigger size.

In accordance with this embodiment, the primary feed line 14 extends from a bottom end to the top of the balun 12 upwards along a height of the balun 12. As an exemplary embodiment, the primary feed line 14 is a straight line with a certain width, extends from the bottom end of the balun 12 to a certain height and then is divided into two branches and extends upwards to enclose the primary square slot 141, and continues extending upwards to enclose the secondary square slot 142 next to the primary square slot 141, finally both branches are combined to one line to extend to the radiating plate 11. The secondary square slot 142 and the primary square slot 141 are separated or connected via a section of horizontal feed line between both slots 141, 142.

In accordance with this embodiment, the secondary feed line 15 also extends from a bottom end to the top of the balun 12 along a height of the balun 12. Two tertiary slots 151 (as labeled in FIGS. 3-4) are etched along the secondary feed line 15 serving as resonance characteristic improvements as well as isolation between the two polarizations. The slots 151 etched at secondary feed line 15 enable to stimulate defected grounded for the primary feed line 14; thus improving resonance. As an exemplary embodiment, the two tertiary slots 151 are formed side by side and in a rectangular shape along the secondary feed line 15. The slots 151 are elongated slots.

The secondary feed line 15 of one polarization faces directly to the primary feed line 14 of the other polarization; thus the slots 151 can also improve the leakage signals from one polarization to another, therefore, the isolation between the two polarizations are improved. In each radiating element 1, there are two primary feed lines 14 and accordingly two secondary feed lines 15, each polarization has a pair of feed lines composed of one primary feed line 14 and one secondary feed line 15 respectively formed on opposite faces of the balun 12 of the polarization. As an exemplary embodiment, the feed lines 14, 15 of each radiating element 1 are arranged in the way that the primary feed line 14 of one polarization located on one face of one balun 12 faces the secondary feed line 15 of the other polarization located on the other face of the other balun 12.

The two tertiary slots 151, the primary and secondary slots 141, 142 enable to have a radiation at a low frequency and cutting-off higher frequency, thus improve an inter-port isolation of the antenna unit 10.

Referring FIGS. 2 and 7 again, the PCB 21 is printed with two two-way splitting networks 25 on the top surface 210. The two two-way splitting networks 25 (in FIG. 2 showing one polarization) are supported on the PCB/filter lid 21, are respectively connected with the two band-pass filters 20 for dual-polarization of the two radiating elements 1. The same polarization from the two radiating elements 1 is connected via one two-way splitting network 25. The two inputs 22 of the two filters 20 can be connected to a set of Transmitter/Receiver units. Each two-way splitting network 25 has one input 250 and two outputs 251. The input 250 is connected with the output 23 of the band-pass filter 20, and the two outputs 251 are respectively connected with the primary feed lines 26 of the two radiating elements 1 with the same polarization.

The integrated antenna unit 10 where the compact band-pass filters 20 are connected to the radiating elements 1, makes use of the compact band-pass components 21 as the radiating elements' supporting boards. Briefly, the integrating order property is from the band-pass filter 20 to the radiating element 1. So that, no low-pass filtering is needed at the band-pass filter 20; thus improving the complexity of traditional band-pass design with cost effective. In addition, the PCB 21 serving as a filter lid and also acts as reflecting board/reflector of the radiating elements 1.

Further referring to FIGS. 8-9, a multi-array antenna 100 is obtained by collocating multi-array integrated antenna units 10, and comprises multi-array radiating elements 1 on multiple band-passed filters 20. The multiple band-passed filters 20 are integrated into a big filter body 22 with multi-PCBs 21 each covered on two filters 20 and supporting two radiating elements 1 thereon. Each integrated antenna unit 10 has same structure as description above. The inputs of the multiple band-pass filters 20 can be connected to a radio unit each; so that multi-array active antennas can be obtained. In FIG. 9, the multiple PCBs/filter lids/reflectors 21 are removed from the multi-array antenna 100 for clearly illustrating and showing the multiple array of radiating elements 1 on the big filter body 22.

FIGS. 9-10 illustrate the Return Loss and Realized Gain respectively of one radiating element 1. From the figures, we can realize a low frequency operation characteristic of one radiating element 1.

Above are just embodiments of the present invention, not limit the scope of the present invention, similar structures or modifications based on the description and drawings, or which are directly or indirectly applied to other field, are all comprised in the scope and spirit of the invention.

The invention claimed is:

1. A radiating integrated antenna unit, comprising:

at least two radiating elements; and an integrated filtering device configured to support the two radiating elements thereon; wherein the integrated filtering device includes two band-pass filters and a PCB configured as a filter lid of both the band-pass filters and covered on top ends of the filters; and the at least two radiating elements extend upwards from a top surface of the PCB.

2. The integrated antenna unit as claimed in claim 1, wherein at least two two-way splitting networks are disposed on the top surface of the PCB;

each radiating element has a radiating surface and baluns under the radiating surface;

each band-pass filter has one input and one output; and each output of the band-pass filter is connected to an input of the two-way splitting network accordingly.

3. The integrated antenna unit as claimed in claim 2, wherein each radiating element is dual-polarization with one monopole for each polarization;

each monopole comprises two radiating arms and one balun;

the dual polarization has two baluns crossed to each other and four arms configured as a radiating plate with the radiating surface thereon; and the same polarization of the two radiating elements is connected via one of the two two-way splitting networks.

4. The integrated antenna unit as claimed in claim 2, wherein each balun comprises a substrate, a primary feed line printed at one face of the substrate, and a secondary feed line printed on the other face of substrate;

the primary feed line is configured as a feeding and carrying point where a signal is inputted;

the secondary feed line is configured as a grounding support of the primary feed line; and at least two outputs of the two-way splitting network are respectively connected the primary feed lines of the two radiating elements with the same polarization.

5. The integrated antenna unit as claimed in claim 4, wherein a primary slot is provided within the primary feed line;

a secondary slot adjacent to the primary slot is provided within the primary feed line; and a combination of both primary and secondary slots has have a low frequency cut-off.

6. The integrated antenna unit as claimed in claim 5, wherein the primary feed line extends from a bottom end to a top of the balun to connect to the radiating plate;

the primary slot and/or the secondary slot is shaped as a square, a rectangle, or a circle; and the secondary slot is located above the primary slot.

7. The integrated antenna unit as claimed in claim 4, wherein at least one tertiary slot is etched along the secondary feed line, and the tertiary slot is configured to enhance a resonance characteristic and an isolation between the two polarizations.

8. The integrated antenna unit as claimed in claim 7, wherein at least two tertiary slots are etched side by side along the secondary feed line.

9. The integrated antenna unit as claimed in claim 1, wherein the PCB is provided as a reflecting board of two radiating elements.

10. The integrated antenna unit as claimed in claim 1, wherein at least two reflecting walls running parallel are provided at edges of the two bandpass filters to support a cavity of the filters; and the at least two reflecting walls being configured to provide pattern beam width control.

11. The integrated antenna unit as claimed in claim 10, wherein the at least two reflecting walls control a 3 dB azimuth beam generated by the radiating elements.

12. The integrated antenna unit as claimed in claim 1, wherein the PCB being configured as the filter lid has a shape well matched with and covered top end surfaces of the two band-pass filters; and the PCB is fixed to the top ends of the two band-pass filters.

13. The integrated antenna unit as claimed in claim 1, wherein each bandpass filter comprises a filter housing, the output of the band-pass filter is set on a top end surface of the filter housing, the input end of the band-pass filter is set at a bottom end surface of the filter housing; and the at least two inputs of the two band-pass filters are connected to a set of Transmitter/Receiver units.

14. A multi-array antenna, comprising multi-array of integrated antenna units as claimed in claim 1, wherein the multi-array antenna comprises multi-array of radiating elements and multiple band-pass filters integrated with multiple PCBs of the integrated antenna units;

each PCB is configured as a filter lid to cover on top ends of two combined band-pass filters in the same integrated antenna unit, and each PCB is configured as a reflector of two radiating elements of dual-polarization.

15. A multi-array antenna as claimed in claim 14, wherein each of the inputs of multiple band-pass filters are connected to a radio unit such that multi-array active antennas are provided.

* * * * *